United States Patent [19]

Lemvig

[11] Patent Number: 4,750,444

[45] Date of Patent: Jun. 14, 1988

[54] SHIPLIFTING DEVICE

[75] Inventor: Svend Lemvig, Ronne, Denmark

[73] Assignee: DME Handels- Og Licensselskab Aps, Denmark

[21] Appl. No.: 12,818

[22] PCT Filed: Apr. 11, 1986

[86] PCT No.: PCT/DK86/00039

§ 371 Date: Dec. 10, 1986

§ 102(e) Date: Dec. 10, 1986

[87] PCT Pub. No.: WO86/06040

PCT Pub. Date: Oct. 23, 1986

[30] Foreign Application Priority Data

Apr. 16, 1985 [DK] Denmark ..... 1714/85

[51] Int. Cl.[4] ..... B63C 1/06

[52] U.S. Cl. ..... 114/45; 405/3

[58] Field of Search ..... 114/44–48, 114/49, 52, 53, 125, 333, 263; 405/1–4

[56] References Cited

U.S. PATENT DOCUMENTS

| | | | |
|---|---|---|---|
| 3,603,276 | 9/1971 | DeLisle | 114/45 |
| 3,727,415 | 4/1973 | Williams | 405/3 |
| 3,951,087 | 4/1976 | Carson | 114/45 |
| 4,149,469 | 4/1979 | Bigler | 114/44 |
| 4,381,723 | 5/1983 | Furst | 114/45 |

FOREIGN PATENT DOCUMENTS 1462047 1/1977 United Kingdom .

*Primary Examiner*—Joseph F. Peters, Jr.
*Assistant Examiner*—Stehpen P. Avila
*Attorney, Agent, or Firm*—Scully, Scott, Murphy & Presser

[57] ABSTRACT

A shiplifting device comprising a platform (1) submersible in a basin and having a deck (2) and a downwardly open lifting skirt (3) positioned below the platform. The shiplifting device supplies and removes air from the lifting skirt and link arms (4, 4') connecting the platform with the quay or parts associated therewith, each link arm at mutually separated points being pivotally connected with the platform and the quay about a substantially horizontal axis of rotation (5, 6; 5',6'), so that the platform maintains its horizontal orientation. The link arms provide buoyancy, and the centers of buoyancy (7, 7') of each moves between a first area in the immediate vicinity of a horizontal plane through the axis of rotation (6, 6') of the link arm (4, 4') in question relative to the quay, and a second area in the immediate vicinity of a vertical plane through the same axis of rotation (6, 6'). The center of buoyancy of each link arm is in the first area when the platform (1) is in its lowermost position (the bottom position), and in the second area when the platform (1) is in its uppermost position (the top position). As a result a comparatively easily maneuverable shiplifting device is provided. This is particularly due to the fact that the buoyancy, with which the link arms (4, 4') influence the platform (1) decreases from being at its maximum in the bottom position of the platform to being at its minimum in the top position of the platform.

10 Claims, 2 Drawing Sheets

SHIPLIFTING DEVICE

TECHNICAL FIELD

The invention relates to a shiplifting device of the kind comprising a platform submersible in a basin and having a deck and a downwardly open lifting skirt positioned below said platform and provided with means for supplying and removing air from the lifting skirt to control the buoyancy of the platform, and comprising link arms connecting the platform with the quay or parts associated therewith, each link arm at mutually separated points being pivotally connected with the platform and the quay about a substantially horizontal axis of rotation, so that the platform maintains its horizontal orientation.

BACKGROUND ART

A ship lifting device is known from U.S. Pat. specification No. 4,381,723 comprising a deck with a downwardly open lifting skirt positioned below the platform and provided with valves for controlling the buoyancy of the deck when air is supplied and removed from the liftingskirt. The air is supplied from the bottom flowing through discharge valves located along the bottom of the basin. The deck with associated lifting skirt is pivotally connected with stationary foundations by means of a parallelogram linkage system. This shiplifting device is encumbered with the drawback that it is not possible to control sufficiently exactly the upward and downward movements of the deck.

DESCRIPTION OF THE INVENTION

It is the object of the present invention to provide a shiplifting device of the above mentioned type, in which it is possible safely and reliably to control the upward and downward movement of the platform, and in which the platform may be stopped at any time during the movement. The shiplifting device according to the invention is characterised in that the link arms form buoyancy means, the centers of buoyancy of which each moves between a first area in the immediate vicinity of a horizontal plane through the axis of rotation of the link arm in question relative to the quay, and a second area in the immediate vicinity of a vertical plane through the same axis of rotation, the center of buoyancy being in the first area when the platform is in its lowermost position (the bottom position), and in the second area, when the platform is in its uppermost position (the top position). As a result a shiplifting device is provided, which is comparatively easy to work. This is particularly due to the fact that the buoyancy, with which the link arms influence the platform, diminishes from maximum in the bottom position of the platform to minimum in the top position of the platform. The manoeuvring stability of the platform is consequently increased due to the fact that the increasing buoyancy by which the amount of air in the lifting skirt influences the platform is currently compensated for as it is being raised. As a result of this compensating effect it is made possible that the platform can only be raised by continuous supply of air and lowered by continuous discharge of air from the lifting skirt, respectively.

According to the invention the link arms on the same side of the platform may be interconnected by means of a pivotal connecting rod which together with the link arms comprises axes of rotation extending parallel to each of the axes of rotation of the link arms in relation to the platform and the quay, respectively, and being located outside a plane containing the two last-mentioned axes of rotation. Thus it is obtained in a simple manner that the platform always maintains its horizontal orientation.

According to a further embodiment of the invention the link arms may be formed as prisms with horizontal axes and cross-sections in the form of a right-angled isosceles triangle, the hypotenuse of which is substantially vertical when the platform is in its bottom position, and substantially horizontal when the platform is in its top position, and that the axes of rotation of the pivotal connection of the link arms with the quay are positioned at the sectionally rectangular corners of the link arms, and that the axes of rotation of the pivotal connection of the link arms with the platform are positioned at the corner, which is the lower when the platform is in its bottom position, and that the axes of rotation of the pivotal connection of the link arms with the connecting rod are positioned at the corner, which is the upper when the platform is in its bottom position. This embodiment has turned out in practice to be particularly advantageous, the intended reduction of the buoyancy effect of the link arms consequently being obtained.

According to a further embodiment of the invention the connecting rods between the link arms may be located in such a manner, that they are at all times above the surface of the water at normal water level. The influences from the environment are thus minimized.

According to a further embodiment of the invention a buoyancy means adjusted to the weight of the platform and the maximum load as well as to the buoyancy of the link arms may be provided on the underside of the deck of the platform. As a result the platform can be adjusted to have only the excess weight necessary for overcoming the buoyancy of the link arms in the bottom position.

Furthermore according to the invention a buoyancy means may, when the platform is in its top position, be substantially above the surface of the water at normal water level. This embodiment has in practice turned out to be particularly advantageous, as the manoeuvering stability is thus improved by the buoyancy of the buoyancy means decreasing when the platform approaches its top position.

According to a further embodiment of the invention the link arms as well as the buoyancy means located in the platform may be formed as means with closed water-tight chambers. This is a very simple and inexpensive solution as regards production.

According to the invention the lifting skirt may be positioned below the buoyancy means, and its upper limiting surface may substantially always be below the surface of the water at normal water level. As a result no losses will occur in the contribution of the lifting skirt to the buoyancy when the platform leaves the surface of the water.

According to a further embodiment of the invention the shiplifting device may comprise four link arms arranged in pairs. This embodiment is particularly simple and particularly applicable for smaller ships.

According to a final embodiment according to the invention mooring devices or wall parts, to which the ship can be moored when raised and lowered, are fastened to the deck. Consequently, the ship can be secured to the platform.

BRIEF DESCRIPTION OF THE DRAWING

The invention will be described below with reference to the accompanying drawing, in which.

DESCRIPTION OF THE PREFERRED EMBODIMENTS OF THE INVENTION

Figure 1:
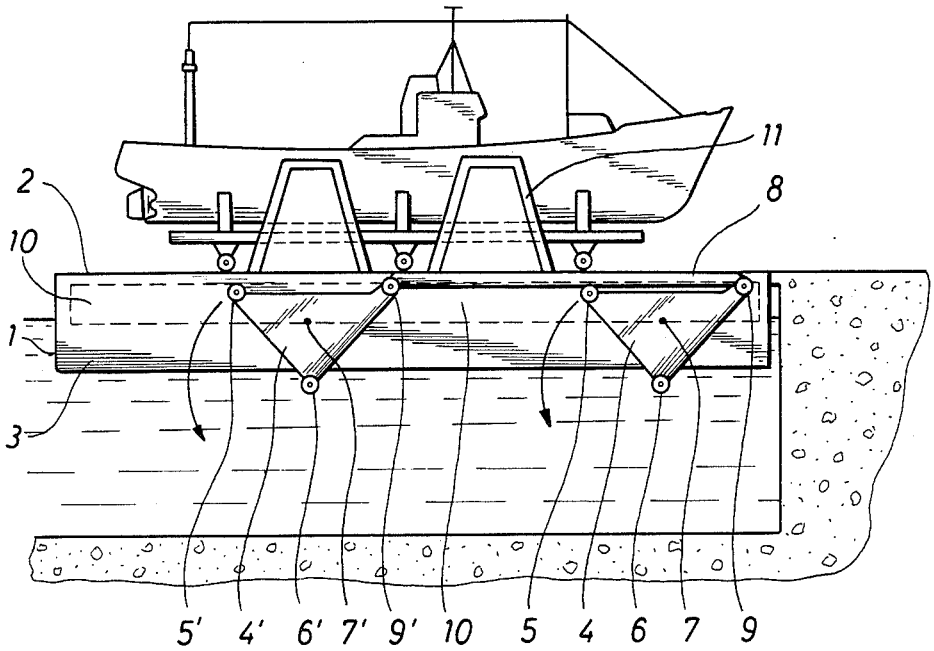
FIG. 1 is a sectional view along the line I—I of FIG. 3 of an embodiment of the shiplifting device according to the invention, in which the platform is in its top position.
Figure 2:
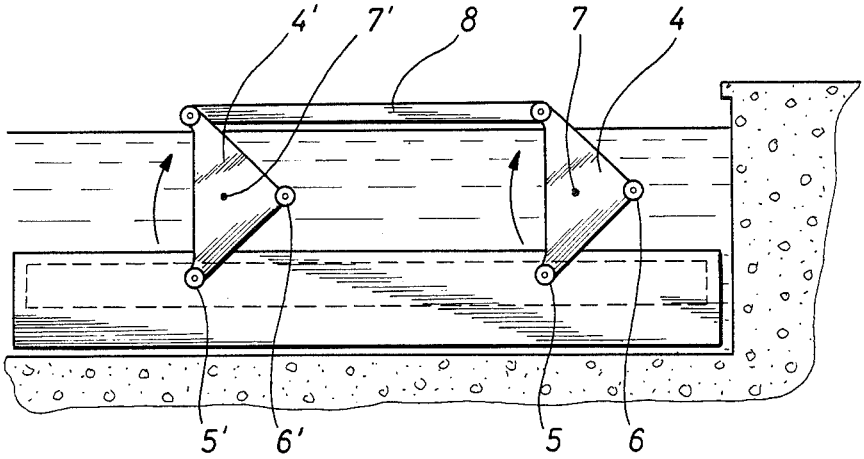
FIG. 2 illustrates the same, in which the platform is in its bottom position.

FIG. 1 illustrates a shiplifting device comprising a platform 1 submersible in a basin and having a deck 2 and a downwardly open lifting skirt 3 positioned below the platform. The vehicle, on which it is desired to place the ship can be positioned on the deck 2. The buoyancy of the platform is controllable by supply or removal of air to or from the lifting skirt 3 by means of means not shown in detail. Four link arms are arranged in pairs on each side of the platform, said link arms partly being pivotally suspended about axes of rotation 6, 6′ connected with the walls of a quay, and partly being pivotally suspended about axis of rotation 5, 5′ connected with the platform. The link arms 4, 4′ located on the same side of the platform are further interconnected by means of a pivotal connecting rod 8, the axes of rotation 9, 9′ of which with the link arms extend parallel to each of the other two axes of rotation 5, 6; 5′, 6′ of the link arms. Each link arm 4, 4′ is formed as a hollow prism with a horizontal axis and with a cross-section in the form of a right-angled isosceles triangle. When the platform is in its top position, the buyoancy centers 7, 7′ of the link arms are immediately above the axes of rotation 6, 6′ with the quay, for which reason the buyoancy of the link arms has no buoyancy effect on the platform. When the platform is in its bottom position—cf. FIG. 2—the buoyancy centers of the link arms are located in a horizontal plane through the axes of rotation relative to the quay, and the buoyancy of the link arms gives a maximum contribution to the buoyancy of the platform. This buoyancy effect decreases as the platform is raised, partly due to the fact that the horizontal projection (the moment arm) of the distance between the buoyancy center and the axis of rotation with the quay decreases, and partly due to the fact that a still greater part of the link arms leaves the surface of the water as the link arms approach the top position.

A buoyancy means 10 adjusted to the weight of the platform and the maximum load as well as to the buoyancy of the link arms is provided on the underside of the deck 2 of the platform 1, said buoyancy means 10 being formed as a closed water-tight chamber, which is above the surface of the water when the platform is close to its top position. Reversely the upper limiting surface of the lifting skirt 3 will not get above the surface of the water at normal water level.

When the platform 1 is in its bottom position it will be moved upwards by supply of air. In order to ensure manoeuvering stability, i.e. that the movement of the platform can be stopped and initiated in all positions, the amount of air in the lifting skirt 3 will in a preferred embodiment of the present invention be of such a magnitude that 10% thereof can be equalized by lost buoyancy effect from the link arms. Immediately before the platform 1 reaches its top position, the buoyancy means located below the deck 2 of the platform will gradually leave the surface of the water, whereby the loss of buoyancy effect is increased further. As a result the platform will in a controlled manner be guided towards the quay.

The lowering of the platform 1 is effected by means of devices for removing air from the lifting skirt 3. As the buoyancy effect of the buoyancy means 10 located below the deck of the platform 1 increases as it leaves the surface of the water, and as the buoyancy effect of the link arms increases proportionally it is possible to perform a controlled lowering of the platform.

Figure 3:
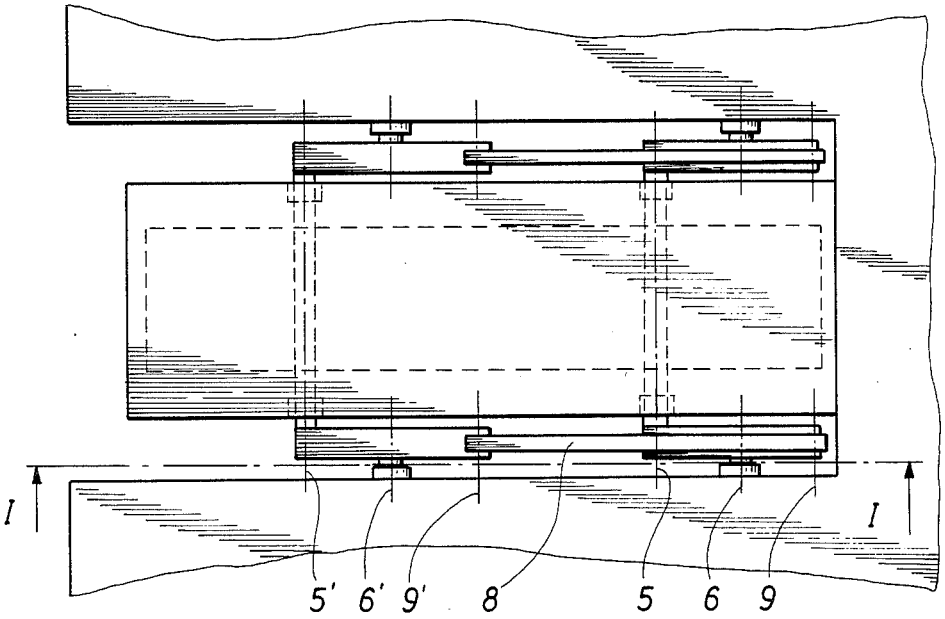
FIG. 3 is a top view of the inventive embodiment shown in FIG. 1.

Mooring devices 11, to which the ship can be moored when raised and lowered, are secured to the deck 2. These devices have been omitted in FIGS. 2 and 3 for the sake of clarity.

It is preferred that the platform and the link arms are made of a comparatively inexpensive plate material, e.g. iron, and that they are hereafter surfaced to be able to resist the corrosive influences to which they are subjected.

The invention may be varied in many ways without thereby deviating from the scope thereof.

What is claimed is:

1. A shiplifting device comprising a platform (1) submersible in a basin and having a deck (2) and a downwardly open lifting skirt (3) positioned below said platform and provided with means for supplying and removing air from the lifting skirt to control the buoyancy of the platform, and comprising link arms (4, 4′) connecting the platform with a quay, each link arm at mutually separated points being pivotally connected with the platform and the quay about a substantially horizontal axis of rotation (5, 6; 5′, 6′), so that the platform maintains its horizontal orientation, characterised in that the link arms form buoyancy means, the centers of buoyancy (7, 7′) of which each moves between a first area in the immediate vicinity of a horizontal plane through the axis of rotation (6, 6′) of the link arm (4, 4′) in question relative to the quay, and a second area in the immediate vicinity of a vertical plane through the same axis of rotation (6, 6′), the center of buoyancy being in the first area when the platform (1) is in its lowermost position (the bottom position), and in the second area when the platform (1) is in its uppermost position (the top position).

2. A shiplifting device as claimed in claim 1, characterised in that the link arms (4, 4′) on the same side of the platform (1) are interconnected by means of a pivotal connecting rod (8) which together with the link arms (4, 4′) comprises axes of rotation (9, 9′) extending parallel to each of the axes of rotation (5, 6; 5′, 6′) of the link arms in relation to the platform and the quay, respectively, and being located outside a plane containing the two last-mentioned axes of rotation.

3. A shiplifting device as claimed in claim 1 characterised in that the link arms (4,4′) are formed as prisms with right triangle shaped cross-sections, the hypotenuse of which is substantially vertical when the platform (1) is in its bottom position, and substantially horizontal when the platform (1) is in its top position, and that the axes of rotation (6, 6′) of the pivotal connection of the link arms (4, 4′) with the quay are positioned at the right angles of the right triangle shaped link arms, and that the axes of rotation (5, 5′) of the pivotal connection of the link arms (4, 4′) with the platform (1) are positioned at the lower corner of said right triangle shaped link arms when the platform is in its bottom position, and that the axes of rotation (9, 9') of the pivotal connection of the link arms (4, 4') with the connecting rod (8) are positioned at the upper corner of said right triangle shaped link arms when the platform is in its bottom position.

4. A shiplifting device as claimed in claim 1, characterised in that the connecting rods (8) between the link arms (4, 4') are located above the surface of the water at normal water level.

5. A shiplifting device as claimed in claim 1, characterised in that a buoyancy means (10) adjusted to the weight of the platform and the maximum load as well as to the buoyancy of the link arms is provided on the underside of the deck (2) of the platform (1).

6. A shiplifting device as claimed in claim 1, characterised in that, when the platform is in its top position, the buoyancy means (10) is substantially above the surface of the water at normal water level.

7. A shiplifting device as claimed in claim 1, characterised in that the link arms (4, 4') as well as the buoyancy means (10) located in the platform are formed as means with closed water-tight chambers.

8. A shiplifting device as claimed in claim 1, characterised in that the lifting skirt (3) is positioned below the buoyancy means (10), and that its upper limiting surface is substantially always below the surface of the water at normal water level.

9. A shiplifting device as claimed in claim 1, characterised by comprising four link arms (4, 4') arranged in pairs.

10. A shiplifting device as claimed in claim 1, characterised in that mooring devices (11), to which the ship can be moored when raised and lowered, are fastened to the deck (2).

* * * * *